US008663138B2

(12) United States Patent
Huster et al.

(10) Patent No.: US 8,663,138 B2
(45) **Date of Patent: *Mar. 4, 2014**

(54) DATA HANDLING FOR HIGH FREQUENCY CHEST WALL OSCILLATION SYSTEM

(75) Inventors: Keith A. Huster, Sunman, IN (US); Gregory A. Branson, Batesville, IN (US); Todd P. O'Neal, Fairfield, OH (US); Mayur Yermaneni, Shrewsbury, MA (US)

(73) Assignee: Hill-Rom Services, Pte. Ltd., Singapore (SG)

( * ) Notice: Subject to any disclaimer, the term of this patent is extended or adjusted under 35 U.S.C. 154(b) by 12 days.

This patent is subject to a terminal disclaimer.

(21) Appl. No.: 13/278,557

(22) Filed: Oct. 21, 2011

(65) Prior Publication Data

US 2012/0035514 A1 Feb. 9, 2012

Related U.S. Application Data

(63) Continuation of application No. 11/737,272, filed on Apr. 19, 2007, now Pat. No. 8,052,626.

(60) Provisional application No. 60/746,921, filed on May 10, 2006.

(51) Int. Cl.
*A61H 31/00* (2006.01)

(52) U.S. Cl.
USPC ..... 601/41; 601/44; 601/149; 601/151

(58) Field of Classification Search
USPC ..... 601/41–44, 148–152; 600/300, 301; 340/539.12; 702/19
See application file for complete search history.

(56) References Cited

U.S. PATENT DOCUMENTS

| | | | | |
|---|---|---|---|---|
| 3,923,043 | A * | 12/1975 | Yanda | 600/541 |
| 4,838,263 | A | 6/1989 | Warwick et al. | |
| 4,977,889 | A | 12/1990 | Budd | |
| 5,056,505 | A | 10/1991 | Warwick et al. | |
| 5,453,081 | A | 9/1995 | Hansen | |
| 5,569,170 | A | 10/1996 | Hansen | |
| 5,769,797 | A | 6/1998 | Van Brunt et al. | |
| 6,030,353 | A | 2/2000 | Van Brunt | |
| 6,036,662 | A | 3/2000 | Van Brunt et al. | |
| 6,210,345 | B1 | 4/2001 | Van Brunt | |
| 6,254,556 | B1 | 7/2001 | Hansen et al. | |
| 6,340,025 | B1 | 1/2002 | Van Brunt | |
| 6,379,316 | B1 | 4/2002 | Van Brunt et al. | |
| 6,415,791 | B1 | 7/2002 | Van Brunt | |
| 6,416,471 | B1 | 7/2002 | Kumar et al. | |
| 6,440,068 | B1 | 8/2002 | Brown et al. | |
| 6,454,708 | B1 | 9/2002 | Ferguson et al. | |
| 6,471,663 | B1 | 10/2002 | Van Brunt et al. | |
| 6,488,641 | B2 | 12/2002 | Hansen | |

(Continued)

*Primary Examiner* — Quang D Thanh
(74) *Attorney, Agent, or Firm* — Barnes & Thornburg LLP

(57) ABSTRACT

A HFCWO apparatus includes a housing having a port, a therapy system carried by the housing and operable to deliver HFCWO therapy to a patient in accordance with a set of operating parameters, and a memory device couplable to the port for storing at least a portion of the set of operating parameters. The therapy system may be operable in accordance with the portion of the set of operating parameters stored in the memory device. The apparatus may comprise a wireless transmitter carried by the housing and operable to wirelessly transmit data relating to HFCWO therapy to a wireless device, such as a printer, PC, a PDA, and the like.

20 Claims, 8 Drawing Sheets

(56) References Cited

U.S. PATENT DOCUMENTS

| | | | | |
|---|---|---|---|---|
| 6,910,479 | B1 | 6/2005 | Van Brunt | |
| 6,916,298 | B2 | 7/2005 | Van Brunt et al. | |
| 6,958,046 | B2 | 10/2005 | Warwick et al. | |
| 7,018,348 | B2 | 3/2006 | Van Brunt et al. | |
| 7,115,104 | B2 | 10/2006 | Van Brunt et al. | |
| 7,121,808 | B2 | 10/2006 | Van Brunt et al. | |
| 8,052,626 | B2 | 11/2011 | Huster et al. | |
| 2002/0016560 | A1 | 2/2002 | Hansen | |
| 2002/0087097 | A1* | 7/2002 | Van Brunt et al. | 600/573 |
| 2004/0097842 | A1 | 5/2004 | Van Brunt et al. | |
| 2006/0136271 | A1 | 6/2006 | Eggers et al. | |
| 2008/0021355 | A1 | 1/2008 | Huster et al. | |
| 2008/0108921 | A1 | 5/2008 | Helgeson et al. | |

* cited by examiner

DATA HANDLING FOR HIGH FREQUENCY CHEST WALL OSCILLATION SYSTEM

CROSS-REFERENCE TO RELATED APPLICATIONS

This application is a continuation of U.S. application Ser. No. 11/737,272, filed Apr. 19, 2007, now U.S. Pat. No. 8,052,626, which claims the benefit of U.S. Provisional Patent Application No. 60/746,921, filed May 10, 2006, each of which is hereby incorporated by reference herein.

BACKGROUND OF THE INVENTION

The present disclosure relates generally to high frequency chest wall oscillation (HFCWO) therapy systems, and more particularly, to HFCWO therapy systems suitable for use in a hospital or healthcare facility.

Manual percussion techniques of chest physiotherapy have been used for a variety of diseases, such as cystic fibrosis, emphysema, asthma and chronic bronchitis, to remove excess mucus that collects in the lungs. To bypass dependency on a caregiver to provide this therapy, chest wall oscillation devices have been developed to deliver HFCWO therapy to a patient. U.S. Patent Application Publication No. 2004/0097842 discloses an illustrative HFCWO therapy system, which is hereby incorporated by reference herein.

SUMMARY OF THE INVENTION

The present invention comprises an apparatus or system that has one or more of the following features or combinations thereof, which alone or in any combination may comprise patentable subject matter:

The apparatus may comprise a housing having a port, a therapy system carried by the housing and operable to deliver HFCWO therapy to a patient in accordance with a set of operating parameters, and a memory device couplable to the port and configured to store at least a portion of the set of operating parameters. The therapy system may be operable in accordance with the portion of the set of operating parameters stored in the memory device. The memory device may comprise a read/write memory. Alternatively or additionally, the memory device may comprise a read-only memory. The apparatus may comprise a garment having a bladder and configured to be positioned on a patient. The memory device may be coupled to the garment.

The memory device may store one or more of a plurality of pre-programmed therapy modes to allow a caregiver to deliver HFCWO therapy to a patient in accordance with any one of the plurality of pre-programmed therapy modes stored in the memory device. The plurality of pre-programmed therapy modes may comprise a step program mode, a sweep program mode, a training program mode, and the like. Alternatively or additionally, the memory device may store one or more of a plurality of customized therapy modes to allow a caregiver to deliver a customized HFCWO therapy to a patient in accordance with any one of the plurality of customized therapy modes stored in the memory device. The memory device may store information regarding functionalities available to a patient. The functionalities available to a patient may comprise a positive expiratory pressure (PEP) therapy, a nebulizer therapy, an intermittent positive pressure breathing (IPPB) therapy, a cough assist therapy, a suction therapy, a bronchial dilator therapy, and the like.

Software of the therapy system may include a subroutine to interface the memory device with a circuit of the therapy system to transfer data to and to retrieve data from the memory device. Alternatively or additionally, software of the therapy system may include a subroutine to interface the memory device with an auxiliary memory of the therapy system to transfer data from the memory device to the auxiliary memory and to transfer data from the auxiliary memory to the memory device.

The memory device may comprise a portable USB device, and the port may comprise a USB interface. The portable USB device may comprise a smart card, and the port may comprise a smart card interface. The smart card may be hot-swappable so that the smart card may be added to or removed from the apparatus without interfering with the operation of the therapy system. The smart card may be programmable so that it can be reconfigured to store a different therapy mode or a different set of functionalities available to a user. The memory device may comprise a Memory Stick® device, and the port may comprise a Memory Stick® interface. The memory device may comprise an iButton® device, and the port may comprise an iButton® connector. The iButton® connector may be located on one of walls of the housing. The apparatus may further comprise a cable connecting the iButton® connector to the iButton® device.

An apparatus is provided for use with a device having a wireless receiver. The apparatus may comprise a housing, a therapy system carried by the housing and operable to deliver HFCWO therapy to a patient, and a wireless transmitter carried by the housing and operable to wirelessly transmit data relating to the HFCWO therapy delivered to the patient to the wireless receiver of the device. The device may comprise a plurality of devices, with each device having a wireless receiver.

A user interface apparatus of the therapy system may comprise a touch screen display. The display may be signaled by software of the therapy system to display a data download screen. The data download screen may comprise a patient list and a list of device selection buttons. The patient list may comprise patient ID numbers. Each device selection button may be associated with one of the plurality of devices. A download confirm screen may be displayed on the display in response to selection of a device selection button on the data download screen. The download confirm screen may comprise a patient list that corresponds to a patient list on the data download screen, a confirm button, and a cancel button. The wireless transmitter may be signaled by the software of the therapy system to wirelessly transfer a patient's data to the selected device in response to selection of the confirm button.

The plurality of devices may comprise one or more of a printer, a PC, a laptop, a PDA button, and the like. One or more of the plurality of devices may be associated with a computer network of a hospital. The data relating to HFCWO therapy delivered to a patient may comprise one or more of the following: a type of the HFCWO therapy, the settings of the various operating parameters associated with the HFCWO therapy, data associated with any tests or assessments of the patient, including graphs and tables of such data, date and time of the therapy, and patient personal information. The data associated with a patient's assessment may comprise spirometry data.

The apparatus may further comprise a wireless receiver carried by the housing and operable to wirelessly receive updates relating to software of the therapy system. Additionally or alternatively, the receiver may be operable to wirelessly receive updates relating to problem diagnoses. The wireless transmitter and/or the wireless receiver may be included as part of a wireless transceiver. Alternatively, the housing may include a data port to receive updates relating to software of the therapy system and/or updates relating to problem diagnoses. The wireless transmission of the data may be in accordance with any protocol, including the following protocols: IrDA, spread spectrum (including the Bluetooth protocol), RS232, TCP/IP, USB, 802.11, and the like.

According to this disclosure, an apparatus may be provided for use with a therapy system operable to deliver HFCWO therapy to a patient in accordance with a set of operating parameters. The apparatus may comprise a garment configured to be positioned on a patient and a memory device coupled to the garment for storing at least a portion of the set of operating parameters. The therapy system may be operable in accordance with the portion of the set of operating parameters stored in the memory device. The therapy system may comprise a housing having a port, and the memory device may be couplable to the port. The apparatus may further comprise a cable configured to couple the port to the memory device. A wand coupled to the cable may interface with the memory device to transfer data from the memory device to a controller of the therapy system.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
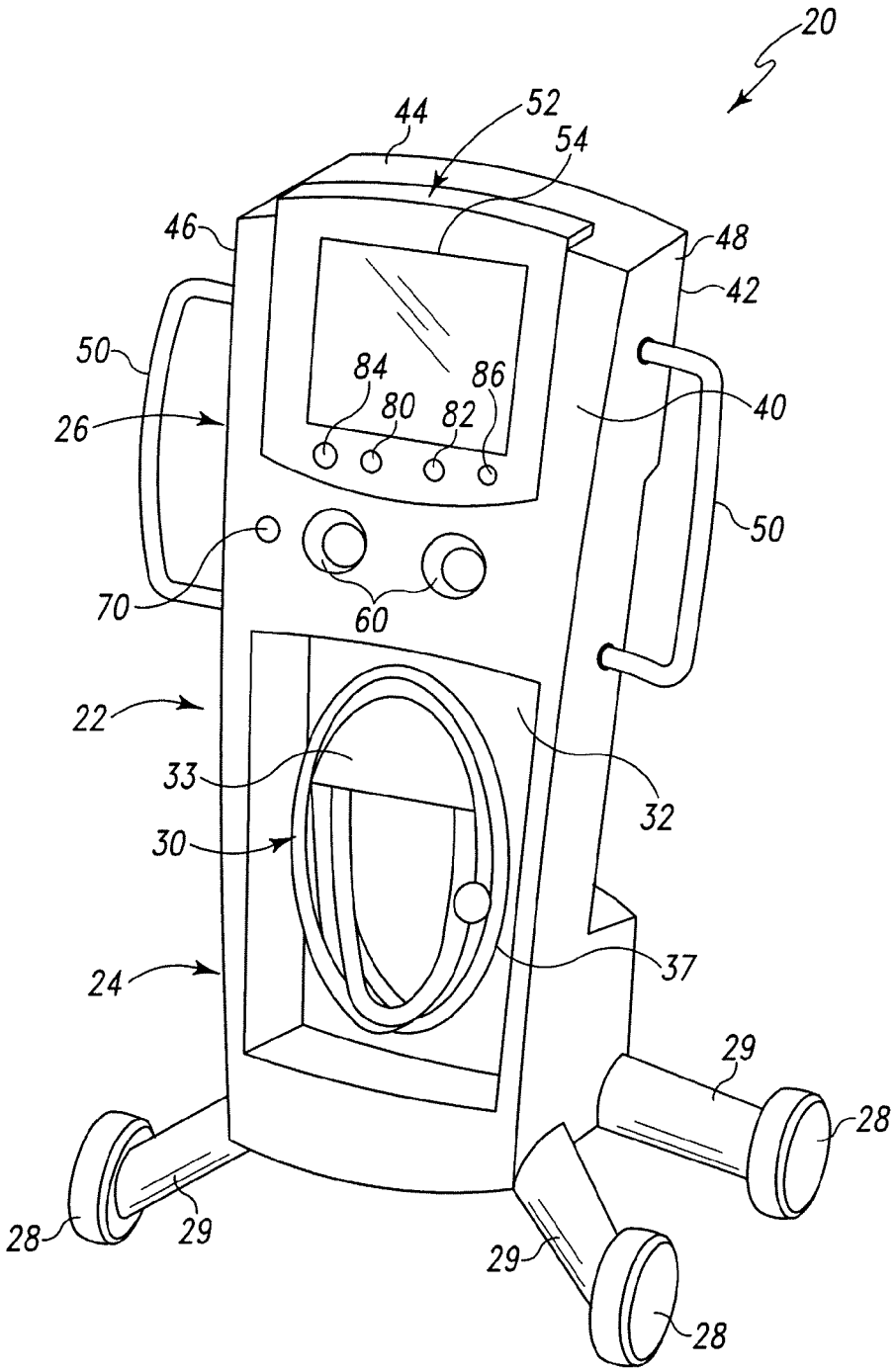
FIG. 1 is a perspective view of an illustrative HFCWO therapy system showing a housing supported on a rolling stand, the housing having a vertically-adjustable large display, a pair of handles, a lower storage compartment, two large air ports through which air pulses are routed from the HFCWO therapy system to a garment, a small pneumatic port to the left of the two large air ports, and four small input ports just below the display screen.

As shown in FIG. 1, a HFCWO therapy system 20 includes a generally box-shaped housing 22 having a lower portion 24 and an upper portion 26. Lower portion 24 is supported on wheels 28 that are rotatably coupled to respective arms 29 that extend outwardly and slightly downwardly from the sides of lower portion 24 of housing 22. Front arms 29 also extend slightly forwardly from the side of housing 22 and rear arms 29 extend slightly rearwardly from the side of housing 22. In some embodiments, front wheels 28 and/or rear wheels 28 are able to swivel about generally vertical axes to facilitate turning of system 20 as it is transported along a floor. System 20 is generally of the type disclosed in U.S. patent application Ser. No. 11/685,285, filed Mar. 13, 2007, and entitled "High Frequency Chest Wall Oscillation System," which is hereby incorporated by reference herein.

Figure 2:
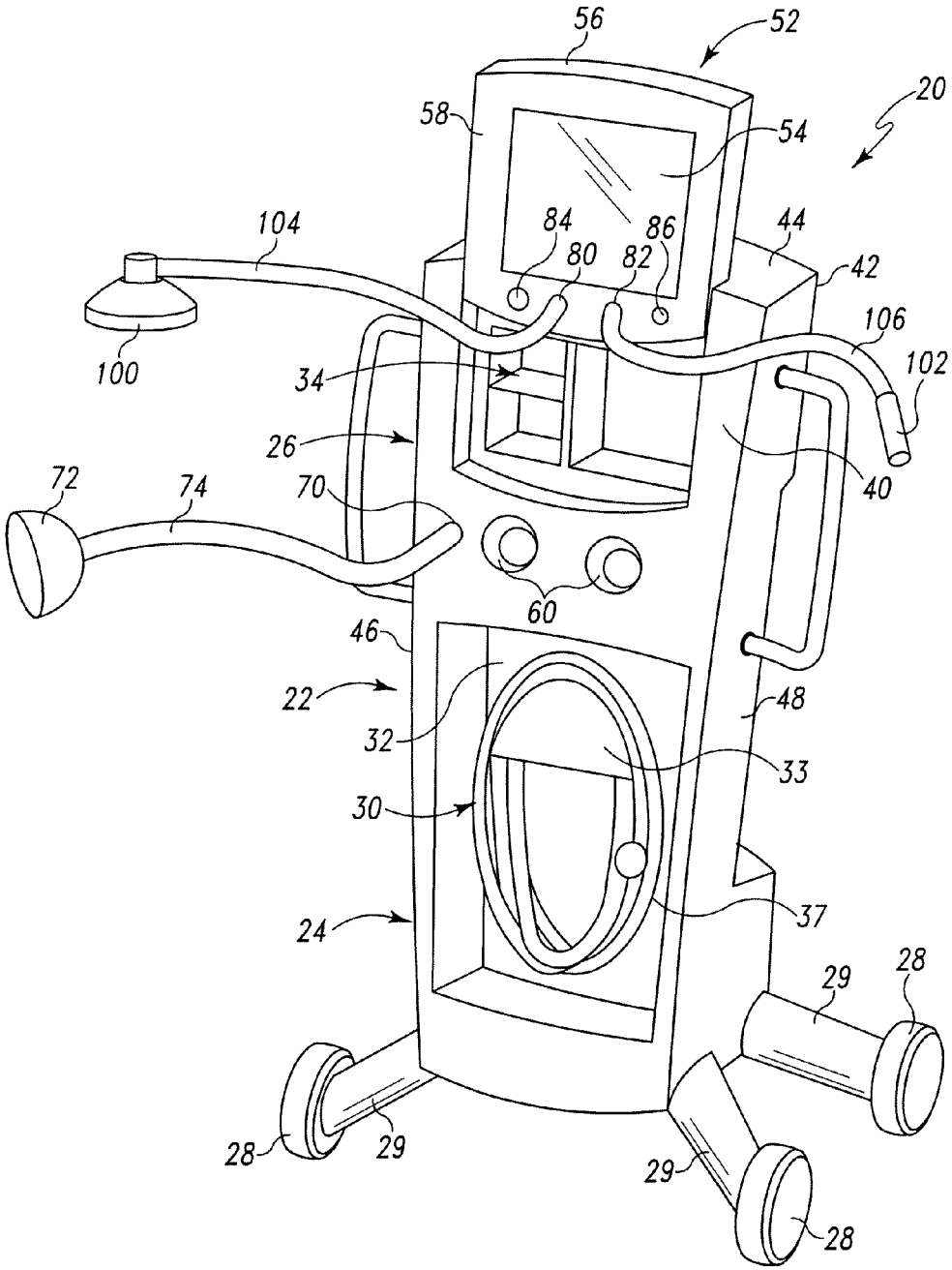
FIG. 2 is a perspective view, similar to FIG. 1, showing the display raised to a higher position in which an upper storage compartment is accessible, a hose coupled to a pressurized air port in the housing and a mask at the end of the hose, and an electronic stethoscope coupled to an input port of the system of FIG. 1.
Figure 3:
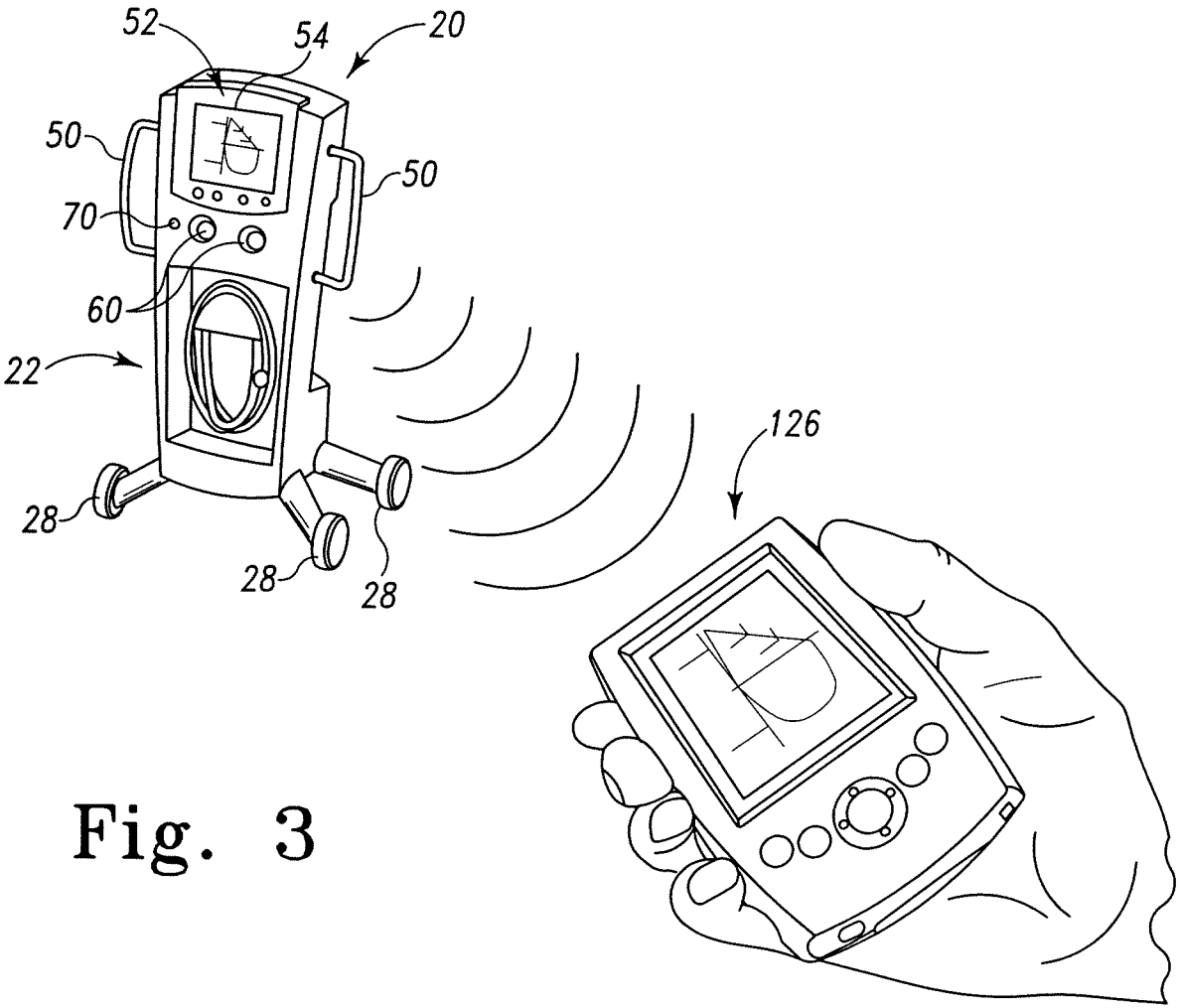
FIG. 3 is a perspective view, similar to FIG. 1, showing the HFCWO therapy system of FIGS. 1 and 2 downloading a patient's data to a portable wireless device, such as a PDA.

Lower portion 24 of housing 22 includes a storage compartment 30 situated behind a door 32 as shown in FIG. 1. Door 32 is movable between a closed position blocking access to compartment 30 and an opened position allowing access to compartment 30. A hook-like cantilevered structure 33 inside compartment 30 supports hoses 37 in a looped or coiled configuration. As shown in FIG. 2, upper portion 26 of housing 22 includes a storage compartment 34. Compartments 30, 34 allow garments, hoses, mouthpieces, masks, sputum bowls, electrical cords, and other equipment associated with HFCWO therapy devices and/or additional respiratory therapy devices and/or assessment systems included in system 20 to be stored in housing 22 and transported from place to place along with system 20.

Figure 7:
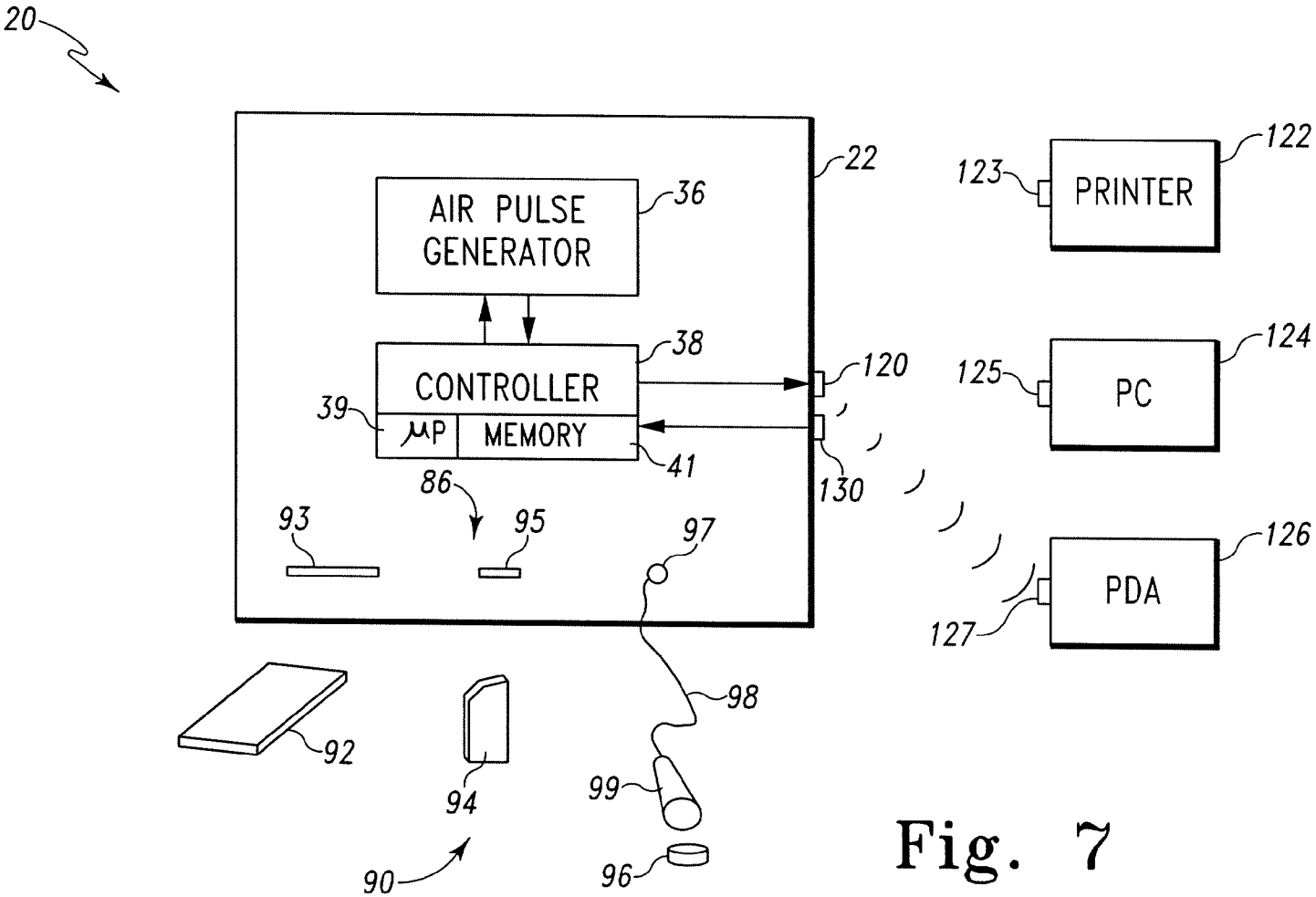
FIG. 7 is a block diagram showing the system of FIGS. 1-3 having a plurality of USB interfaces for communicating with memory devices, such as a smart card, a Memory Stick® device and an iButton® device, a wireless receiver for receiving software updates, and a wireless transmitter for transmitting a patient's data to a selected device, such as a printer, a PC and a PDA.

As diagrammatically shown in FIG. 7, system 20 includes an air pulse generator 36. Such an air pulse generator 36 may comprise, for example, a blower (not shown) and an air chamber assembly (not shown). In addition, system 20 includes a controller 38. Air pulse generator 36 and controller 38 are located within housing 22. As alluded to above, air pulse generator 36 is situated in the lower part of lower portion 24 of housing 22 in the illustrative embodiment. Controller 38 comprises one or more circuit boards and the associated circuitry which may be located anywhere within housing 22 at the option of the system designer. In some embodiments, system 20 has an on-board battery which is housed within the lower part of lower portion 24. Air pulse generator 36 and controller 38 are generally of the type disclosed in the previously mentioned U.S. Pat. Application Pub. No. 2004/0097842, which is already incorporated by reference herein.

In the illustrated embodiment, system 20 includes components operable to provide HFCWO therapy to a patient. Additionally and alternatively, system 20 includes components operable to provide additional respiratory therapies to a patient and components for assessing the efficacy of the various therapies. Examples of additional respiratory therapies for which the associated components may be included as part of system 20 include a cough assist therapy, a nebulizer therapy, a suction therapy, a positive expiratory pressure (PEP) therapy, an intermittent positive pressure breathing (IPPB) therapy, and a bronchial dilator therapy. Examples of components of assessment systems which may be included as part of system 20 include an electronic stethoscope 100 (FIG.

2), a spirometer couplable to a spirometer mouthpiece 102 (FIG. 2), and a flow meter. The devices and accessories used for these additional therapies and the assessment systems may be stored in storage compartments 30, 34, if desired.

As shown in FIGS. 1 and 2, upper portion 26 includes a front wall 40, a rear wall 42, a top wall 44, and a pair of side walls 46, 48. A pair of C-shaped handles 50 are coupled to side walls 46, 48 of housing 22 and are grippable by a caregiver to maneuver system 20 along a floor. A user interface, such as a video monitor or display 52 having a display screen 54, is coupled to front wall 40 for vertical movement between a lowered position shown in FIG. 1 in which display 52 blocks access to upper storage compartment 34 and a raised position shown in FIG. 2 in which upper storage compartment 34 is accessible. The height of display 52 relative to housing 22 is adjustable to suit the caregiver's convenience. Electrical lines, such as wires or cables, are routed through housing 22 to provide an electrical connection between display 52 and controller 38. Display 52 has a housing 56 having a front wall 58. In the illustrated embodiment, display screen 54 comprises a touch screen display panel.

In the illustrated embodiment, controller 38 includes a microprocessor 39 (FIG. 7). Software of system 20 is stored in one or more on-board memories 41 (FIG. 7) associated with microprocessor 39. Microprocessor 39 executes the software to cause various screens and various data to appear on display screen 54. Display screen 54 allows the caregiver to control the operation of air pulse generator 36 to deliver HFCWO therapy to a patient in accordance with a set of operating parameters, such as the frequency of air pulses, the amplitude of the air pulses, the duration of the HFCWO therapy, just to name a few. In some embodiments, the frequency of air pulses is variable between about 0 Hz to about 20 Hz, the steady state pressure of air pulses is variable between about 0.10 PSI and about 1.20 PSI, and the duration of the HFCWO therapy is variable between about 10 minutes and about 20 minutes. Other embodiments may have minimum and maximum operating parameters that are different than these listed values.

In addition, display screen 54 allows the caregiver to control the operation of any of the additional respiratory therapy system(s) and/or assessment system(s) included in system 20. The set of operating parameters may be stored in the on-board memory 41 associated with microprocessor 39. Additionally or alternatively, a portion of the set of operating parameters may be stored in a memory device 90 (FIG. 7), configured to be coupled to microprocessor 39 (FIG. 7) via an input port 86 (FIGS. 1 and 7). In the illustrated embodiment, memory device 90 is an external USB device and input port 86 is an externally accessible USB interface. Examples of memory device 90 include a smart card, an iButton® device, a Memory Stick® device, and the like.

Figure 8:
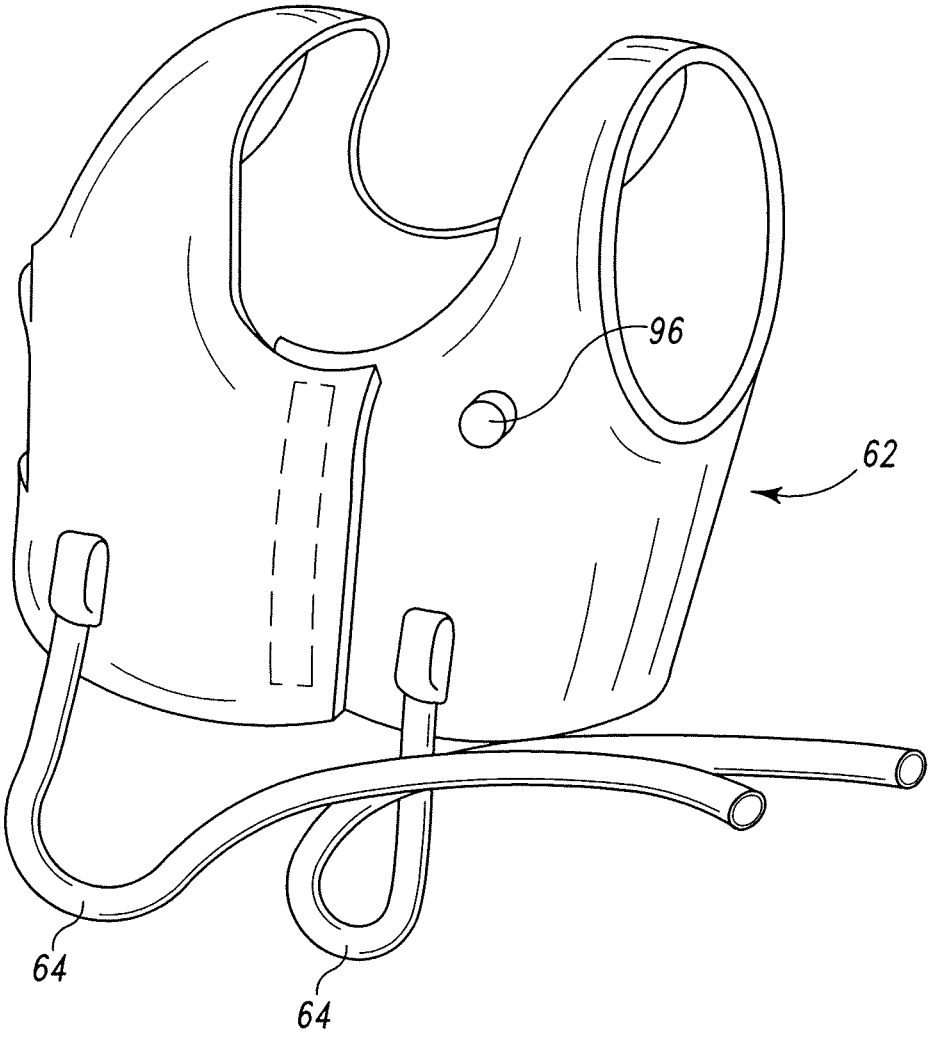
FIG. 8 is a perspective view of a garment suitable for use with the system of FIGS. 1-3 showing an iButton® device coupled to the garment.

Front wall 40 of housing 22 has two large air ports 60 which are configured to be coupled to a HFCWO therapy garment 62, shown in FIG. 8, via hoses 64. Garment 62 has at least one bladder and is configured to be positioned on a patient receiving HFCWO therapy. In response to user inputs, microprocessor 39 of system 20 signals air pulse generator 36 to deliver high frequency air pulses to the patient in accordance with a set of operating parameters. Front wall 40 has an additional pneumatic port 70 to the left of air ports 60. Port 70 is couplable to a mask 72 via a hose 74. In some embodiments, port 70 may also be couplable to a nebulizer mouthpiece (not shown). Mask 72 and the nebulizer mouthpiece are used with system 20 when system 20 performs one or more of the integrated additional therapies such as, for example, the nebulizer therapy, the cough assist therapy, and the PEP therapy, just to name a few. In the illustrated embodiment, suction or negative pressure may be applied to port 70 by system 20 for ultimate application to mask 72 or the nebulizer mouthpiece coupled to port 70. Another example of a garment suitable for use with system 20 is disclosed in U.S. Pat. No. 6,916,298, which is hereby incorporated by reference herein.

In addition, front wall 58 of display 52 has a plurality of input ports 80, 82, 84, 86 located just below display screen 54. In other embodiments, input ports 80, 82, 84, 86 are provided on front wall 40 of housing 22, instead of on front wall 58 of display 52. In still other embodiments, one or more input ports 80, 82, 84, 86 are provided on a different wall of system 20 or on a different wall of housing 56 of display 52. Electrical lines, such as cables or wires, provide an electrical connection between input ports 80, 82, 84, 86 and controller 38 of system 20. Input ports 80, 82 are configured to be connected to electronic assessment systems, such as an electronic stethoscope 100, a spirometer mouthpiece 102, and the like. As shown in FIG. 2, input port 80 is couplable to electronic stethoscope 100 via a line 104 and input port 82 is couplable to spirometer mouthpiece 102 via a hose 106. In some embodiments, one or more input ports 80, 82, 84, 86 may be omitted.

Updates relating to system software and/or updates relating to problem diagnosis are received via input port 84. Memory device 90 is configured to be coupled to input port 86. In the illustrated embodiment, at least a portion of the set of operating parameters of air pulse generator 36 are stored in memory device 90. As noted, microprocessor 39 of system 20 signals air pulse generator 36 to deliver high frequency air pulses to a patient in accordance with the portion of the set of operating parameters stored in memory device 90. In some embodiments, memory device 90 is configured to store one or more of a plurality of pre-programmed therapy modes to allow a caregiver to deliver HFCWO therapy to a patient in accordance with any one of the plurality of pre-programmed therapy modes stored in memory device 90. Examples of the pre-programmed therapy modes include a step program mode, a sweep program mode, a training program mode, and the like.

The step and sweep program modes are substantially as described in U.S. Patent Application Publication No. US 2004/0097842, which is already incorporated by reference herein. The training program mode allows the caregiver to start at a desired starting frequency and/or intensity for the HFCWO therapy and automatically gradually increase the frequency and/or intensity over a predetermined period of time or a programmed period of time to a desired maximum frequency and intensity. This is useful for frail patients and patients that are not accustomed to HFCWO therapy in order to help them get accustomed to this type of therapy before using more powerful settings.

Additionally or alternatively, memory device 90 is configured to store one or more of a plurality of customized therapy modes to allow a caregiver to deliver HFCWO therapy to a patient in accordance with any one of the plurality of customized therapy modes stored in memory device 90. In the custom program mode, the caregiver is able to create a special waveform for a particular patient's therapy. Such a special waveform may be in accordance with wave type, frequency, pressure, and timing parameters of the caregiver's choosing or may be in accordance with a menu of special waveforms preprogrammed into system 20. In one example of a possible custom waveform, system 20 operates according to a step program mode for a first period of time and then changes automatically to a sweep program mode for a second period of time. Once a caregiver creates a custom program, the operating parameters are transmitted by controller 38 to memory device 90 via port 86 for storage in memory device 90 and for downloading back to controller 38 via port 86 at a later point in time.

In still other embodiments, memory device 90 is configured to store information regarding functionalities available to a patient. Examples of functionalities available to a patient include one or more of a positive expiratory pressure (PEP) therapy, a nebulizer therapy, an intermittent positive pressure breathing (IPPB) therapy, a cough assist therapy, a suction therapy, a bronchial dilator therapy, and the like.

In some embodiments, memory device 90 comprises a read-only memory (ROM). In such embodiments, ROM device 90 can only be read to access data stored therein. Illustratively, the software of system 20 includes a subroutine to interface ROM device 90 with a circuit of controller 38 to retrieve data from ROM device 90. Additionally or alternatively, the software of system 20 includes a subroutine to transfer data from ROM device 90 to an auxiliary memory of system 20. Alternatively, memory device 90 comprises a read/write memory, such as a random access memory (RAM). In such embodiments, RAM device 90 can be reconfigured to store a different set of operating parameters, a different therapy mode or a different set of functionalities available to a user. Illustratively, the software of system 20 includes a subroutine to interface RAM device 90 with a circuit of controller 38 to transfer data to and to retrieve data from RAM device 90. Additionally or alternatively, system 20 includes a subroutine to transfer data from RAM device 90 to the auxiliary memory and to transfer data from the auxiliary memory to RAM device 90.

In the illustrated embodiments, memory device 90 comprises a portable USB device, and port 86 comprises a USB read/write interface. Examples of such USB devices include a smart card, an iButton® device, a Memory Stick® device, and the like. In embodiments in which memory device 90 comprises a smart card 92 (FIG. 7), port 86 comprises a card-receiving slot 93 (FIG. 7) having a smart card interface. Smart card 92 may be hot-swappable so that the smart card can be added to or removed from system 20 without interfering with the operation of system 20. Also, the smart card may be programmable so that it can be reconfigured to store a different set of operating parameters, a different therapy mode or a different set of functionalities available to a user.

In embodiments in which memory device 90 comprises a Memory Stick® device 94 (FIG. 7), port 86 comprises a Memory Stick® interface 95 (FIG. 7). In embodiments in which memory device 90 comprises an iButton® device 96 (FIG. 7), port 86 comprises an iButton® interface 97 (FIG. 7). In some embodiments, as shown, for example, in FIG. 8, iButton® device 96 is coupled to garment 62 and transported therewith. In such embodiments, a cable 98 (FIG. 7) carrying a probe 99 may connect iButton® device 96 coupled to garment 62 to interface 97. One way of coupling iButton® device 96 to garment 62 is non-removable coupling, such as clipping, sewing, heat welding, etc. Another way of coupling iButton® device 96 to garment 62 is removable coupling, such as placing iButton® device 96 in a pocket of garment 62. In embodiments where iButton® device 96 is placed in the pocket of garment 62, iButton® device 96 is removed from the pocket and snapped into a holder of interface 97 for continuous connection with controller 38. In some embodiments, iButton® device 96 may communicate with controller 38 with just a momentary contact between iButton® device 96 and interface 97.

Figure 4:
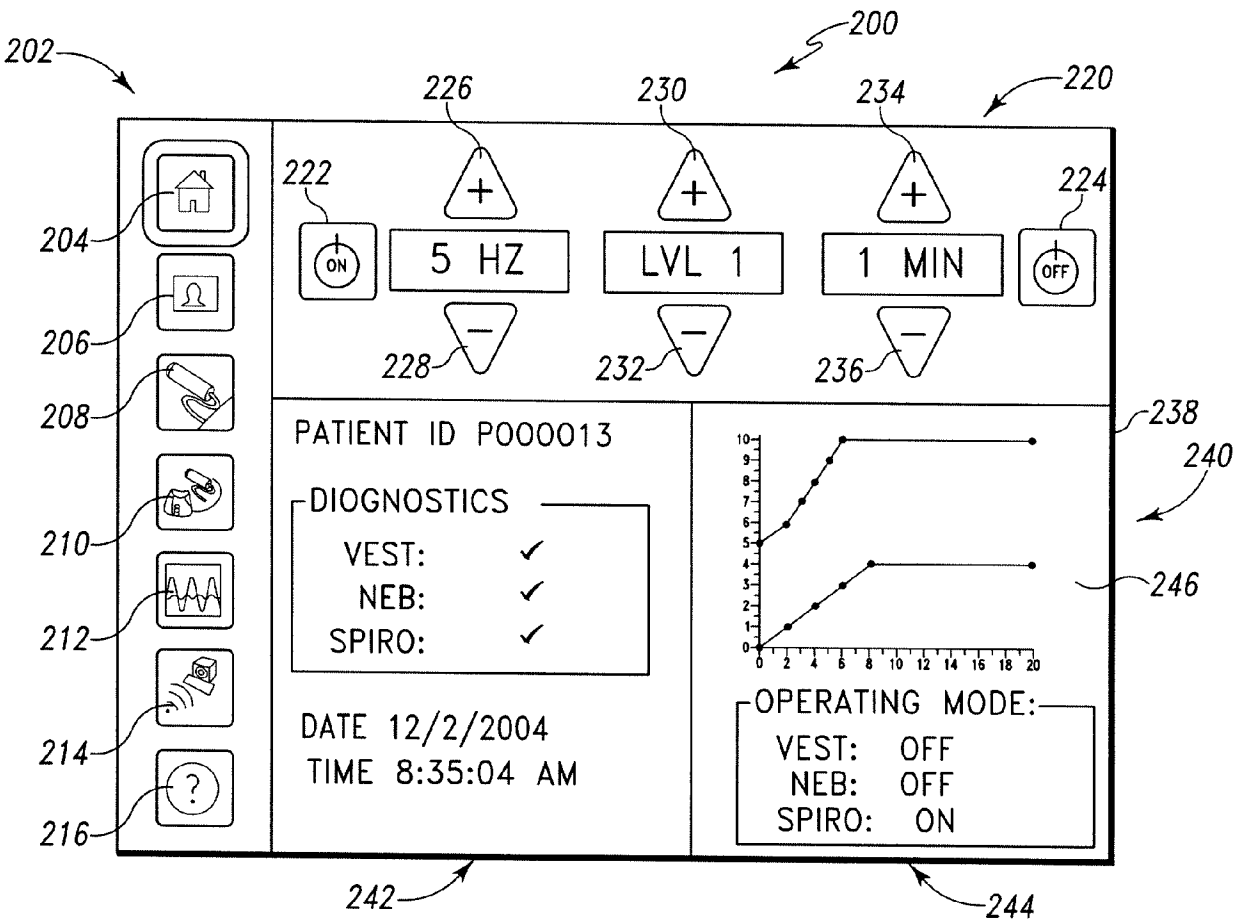
FIG. 4 is a screen shot of a home screen of the system of FIGS. 1-3.
Figure 5:
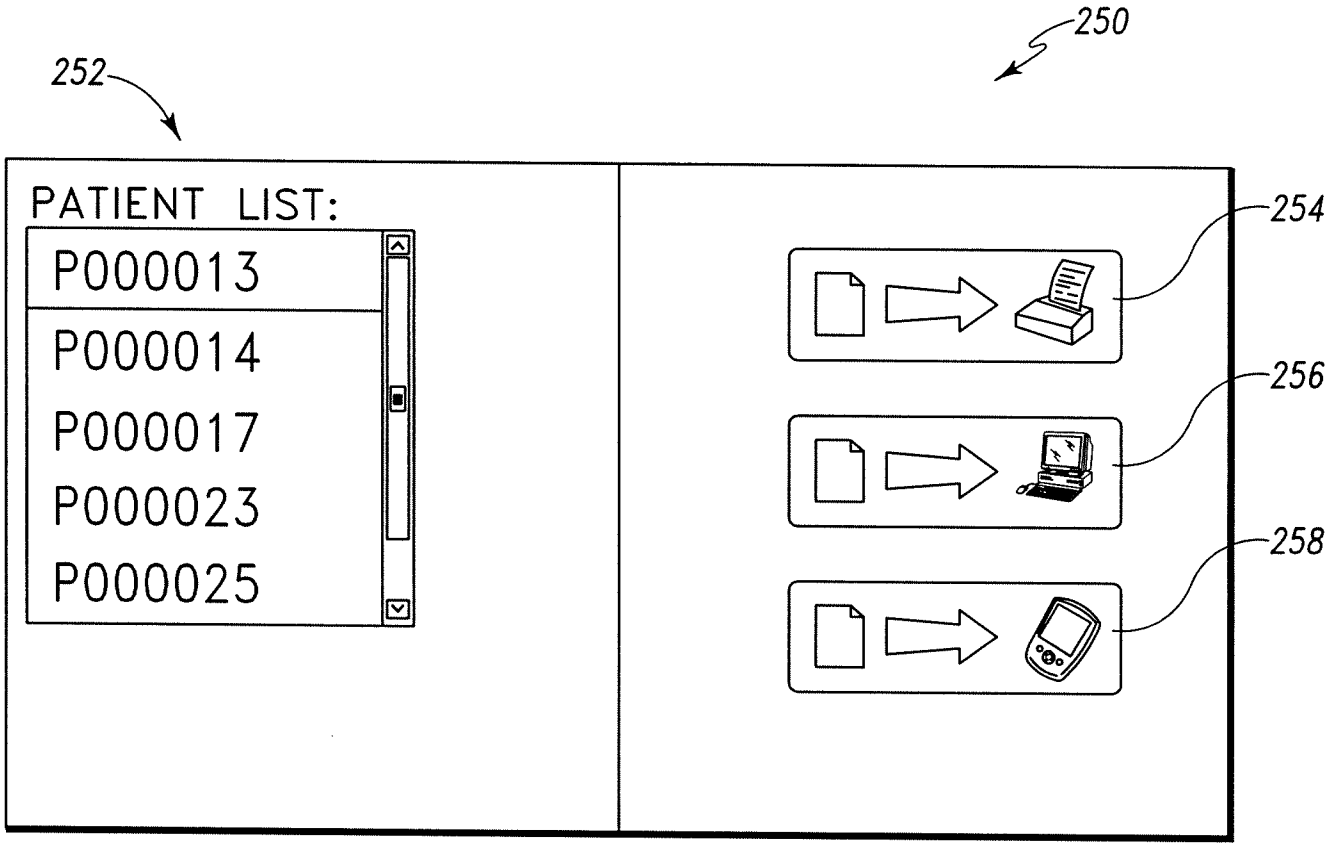
FIG. 5 is a screen shot of a data download screen of the system of FIGS. 1-3 showing a patient list on a left side of the screen and device selection buttons on a right side of the screen that are usable to initiate a data transmission from the system to a printer, a PC, or a PDA.
Figure 6:
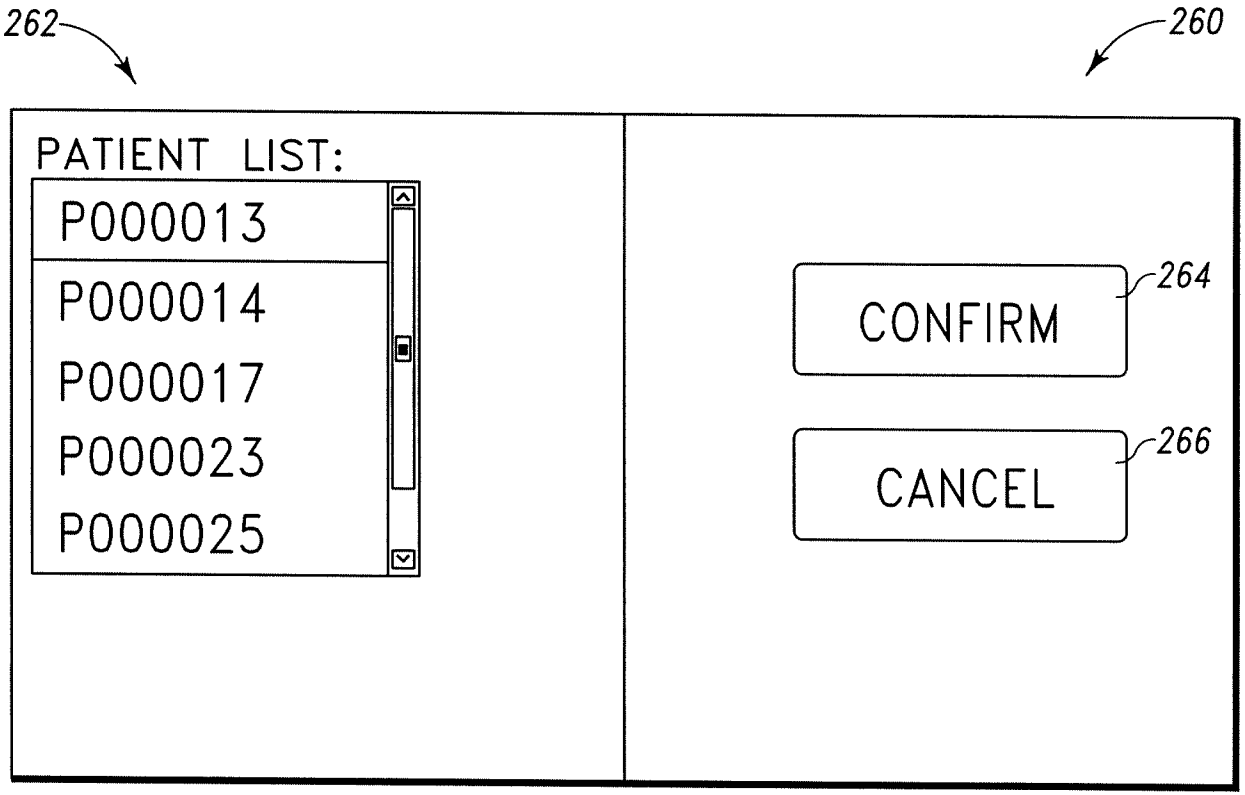
FIG. 6 is a screen shot of a data download confirm screen of the system of FIGS. 1-3 showing a patient list on a left side of the screen and buttons on a right side of the screen that are usable to confirm or to cancel transmission of data to a selected device.

As indicated, system 20 includes software that is stored in one or more memories 41 associated with controller 38 that, when executed, causes various user interface screens, such as the user interface screens shown in FIGS. 4-6, to be displayed on display screen 54 at different times depending upon user inputs to system 20. FIG. 4 is a screen shot of a home screen 200 that appears on display screen 54. Screen 200 is a default screen that is normally shown on display screen 54. Thus, if other screens discussed herein are shown but a user does not provide any inputs to system 20 during the display of such screens for a predetermined timeout period, or if system 20 finishes acquiring data and/or displaying the acquired data for a predetermined timeout period, the system 20 may automatically default to displaying home screen 200.

On a left side of home screen 200 is a mode change field 202 which includes a home screen icon 204, a patient icon 206, a spirometer icon 208, a vest & spirometer icon 210, a vest program icon 212, a data download icon 214, and a help icon 216. On an upper right side of home screen 200 is a value change field 220 which includes the following buttons or icons: on button 222, off button 224, upper left button 226, lower left button 228, upper middle button 230, lower middle button 232, upper right button 234 and lower right button 236. The caregiver may modify the operation of the air pulse generator 36 by using buttons 226, 228, 230, 232, 234, 236. The function of buttons 226, 228, 230, 232, 234, 236 may vary depending on the current state or mode of air pulse generator 36 and furthermore, buttons associated with controlling others of the therapies or functions of system 20 may be displayed in field 220 in lieu of buttons 226, 228, 230, 232, 234, 236.

On a lower right side of home screen 200 is a window 238. A status field 240 appears in window 238 of home screen 200 in response to the caregiver selecting home screen icon 204, or in response to system 20 automatically displaying home screen 200. Left side 242 of status field 240 includes a patient ID number, a list of devices connected to one or more of the ports of system 20, and the date and the time that an associated therapy was administered. In the illustrated example of screen 200, a vest, a nebulizer and a spirometer are coupled to system 20.

Lower right side 244 of status field 240 shows an indication of which of the devices connected to system 20 are on or enabled or currently being used. Upper right side 246 of status field 240 shows tabular, numerical, and/or graphical data indicative of the operation and/or the output of one or more of the therapy devices of system 20. In the illustrated example of screen 200, a spirometer is on, while the vest (e.g., air pulse generator 36) and the nebulizer are off. Also in the illustrative example, portion 246 has displayed therein a graph of data associated with the HFCWO therapy of system 20. In some embodiments, the data shown on portion 246 of window 238 is selectable by touching the associated operating mode description (e.g., "vest," "neb," and "spiro") on portion 244 of window 238.

FIG. 5 is a screen shot of a data download screen 250 that appears in window 238 in response to the caregiver selecting data download icon 214 on home screen 200. On a left side of data download screen 250 is a patient list 252, which lists the patient ID numbers. In some embodiments, a particular patient is selected by touching the patient ID number on screen 250. On a right side of data download screen 250 are a printer button 254, a PC button 256 and a portable wireless device button 258. Buttons 254, 256, 258 are touched to initiate a data transfer of a patient's data (e.g., date and time of therapy sessions provided to the patient by system 20, types of therapy delivered to the patient by system 20, the settings of the various parameters associated with the therapy sessions, the data associated with any tests or assessments of the patient made by system 20 including graphs and tables of such data, and patient information stored in system 20) to a printer 122, a PC 124, or a portable wireless device 126 (such as a PDA), respectively, schematically shown in FIG. 7.

FIG. 6 is a screen shot of a data download confirm screen 260 that appears in window 238 in response to the caregiver selecting one of buttons 254, 256, 258. On a left side of the data download confirm screen 260 is a patient list 262 that corresponds to patient list 252 on screen 250. On a right side of the data download confirm screen 260 are confirm and cancel buttons 264, 266. As shown diagrammatically in FIG. 7, in the illustrated embodiment, system 20 includes a wireless transmitter 120 and each of devices 122, 124, 126 includes an associated wireless receiver 123, 125, 127, respectively. Transmitter 120 is operable to wirelessly transmit data to an associated device, such as printer 122, PC 124 or PDA 126, in response to caregiver selecting confirm button 264 on data download confirm screen 260. In the illustrated embodiment, confirm button 264 is selected by touching it. In addition, as shown in FIG. 7, system 20 includes a wireless receiver 130 to wirelessly receive updates relating to software of system 20 and/or updates relating to problem diagnoses. In some embodiments, transmitter 120 and receiver 130 are included as part of a wireless transceiver. The wireless transmission of data may be in accordance with any protocol, including the following protocols: IrDA, spread spectrum (including the Bluetooth protocol), RS232, TCP/IP, USB, 802.11, and the like.

In some embodiments, the data stored in system 20 is transmitted via a wired connection to an associated device coupled to system 20. Additionally or alternatively, system 20 may be coupled either wirelessly and/or via a wired connection to a network of computer devices, such as local area network (LAN), a wide area network (WAN), an Ethernet of a healthcare facility, or the Internet. A destination ID may be programmed into system 20 or entered by a user to specify a device of the network to which the data from system 20 is to be transmitted.

Although certain illustrative embodiments have been described in detail above, variations and modifications exist within the scope and spirit of this disclosure as described and as defined in the following claims.

The invention claimed is:

1. A high frequency chest wall oscillation (HFCWO) apparatus for use with a patient, the apparatus comprising:

a housing having a first port, a second port configured to couple to an electronic stethoscope, a third port that is a pneumatic port and that is coupled to a mouthpiece of a spirometer via a hose that extends from the third port, and a fourth port through which a respiratory therapy is delivered to the patient, a therapy system carried by the housing and operable to deliver HFCWO therapy to a patient in accordance with a set of operating parameters, and a memory device for storing at least a portion of the set of operating parameters, the memory device being couplable to the first port, the HFCWO therapy being operated in accordance with the portion of the set of operating parameters stored in the memory device.

2. The apparatus of claim 1, wherein the memory device is configured to store one or more of a plurality of pre-programmed therapy modes to allow a caregiver to deliver HFCWO therapy to a patient in accordance with any one of the plurality of pre-programmed therapy modes stored in the memory device, and wherein each of plurality of pre-programmed therapy modes includes a portion of the set of operating parameters.

3. The apparatus of claim 2, wherein the plurality of pre-programmed therapy modes comprise a step program mode, a sweep program mode, and a training program mode.

4. The apparatus of claim 1, wherein the memory device is configured to store one or more of a plurality of customized therapy modes to allow a caregiver to deliver HFCWO therapy to a patient in accordance with any one of the plurality of customized therapy modes stored in the memory device, and wherein each of the plurality of customized therapy modes includes a portion of the set of operating parameters.

5. The apparatus of claim 1, wherein the memory device is further configured to store information regarding the respiratory therapy.

6. The apparatus of claim 5, wherein the respiratory therapy comprises at least one of a positive expiratory pressure (PEP) therapy, a nebulizer therapy, an intermittent positive pressure breathing (IPPB) therapy, a cough assist therapy, a suction therapy, and a bronchial dilator therapy.

7. The apparatus of claim 1, wherein software of the therapy system includes a subroutine to interface the memory device with a circuit of the therapy system to transfer data to and to retrieve data from the memory device.

8. The apparatus of claim 1, wherein software of the therapy system includes a subroutine to interface the memory device with an auxiliary memory of the therapy system to transfer data from the memory device to the auxiliary memory and to transfer data from the auxiliary memory to the memory device.

9. The apparatus of claim 1, wherein the memory device comprises at least one of a read/write memory and a read-only memory.

10. The apparatus of claim 1, further comprising a garment having a bladder and configured to be positioned on a patient, wherein the therapy system is operable to deliver HFCWO therapy to the patient by providing high frequency air pulses to the bladder, and wherein the memory device is coupled to the garment.

11. The apparatus of claim 1, further comprising a wireless transmitter carried by the housing and operable to wirelessly transmit data relating to the HFCWO therapy.

12. The apparatus of claim 11, wherein the data relating to HFCWO therapy comprises a type of the HFCWO therapy or settings of the operating parameters associated with the HFCWO therapy.

13. The apparatus of claim 11, wherein the wireless transmitter is also operable to wirelessly transmit data relating to the respiratory therapy.

14. The apparatus of claim 11, wherein the wireless transmitter is also operable to wirelessly transmit spirometry data.

15. The apparatus of claim 11, further comprising a wireless receiver carried by the housing and operable to wirelessly receive updates relating to software of the therapy system.

16. The apparatus of claim 15, wherein the transmitter and the receiver are included as part of a transceiver.

17. The apparatus of claim 1, wherein the housing includes a data port to receive updates relating to software of the therapy system.

18. The apparatus of claim 1, further comprising a display screen coupled to the housing.

19. The apparatus of claim 18, wherein the display screen comprises a touch screen having user inputs to control the HFCWO therapy.

20. The apparatus of claim 18, wherein the display screen is operable to display graphical data relating to at least one of a spirometry assessment, the HFCWO therapy, and the respiratory therapy.

* * * * *

UNITED STATES PATENT AND TRADEMARK OFFICE

CERTIFICATE OF CORRECTION

PATENT NO. : 8,663,138 B2
APPLICATION NO. : 13/278557
DATED : March 4, 2014
INVENTOR(S) : Keith A. Huster et al.

It is certified that error appears in the above-identified patent and that said Letters Patent is hereby corrected as shown below:

On the Title Page:

Item (75), the inventor's name reading "Gregory A. Branson" should read --Gregory W. Branson--.

Signed and Sealed this
Sixth Day of May, 2014

Michelle K. Lee

Michelle K. Lee
*Deputy Director of the United States Patent and Trademark Office*